US009014606B2

(12) United States Patent
Yamamoto et al.

(10) Patent No.: US 9,014,606 B2
(45) Date of Patent: Apr. 21, 2015

(54) IMAGE FORMING APPARATUS AND IMAGE FORMING METHOD

(71) Applicant: Konica Minolta, Inc., Tokyo (JP)

(72) Inventors: Koji Yamamoto, Tokyo (JP); Hiroshi Funabiki, Tokyo (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/652,691

(22) Filed: Oct. 16, 2012

(65) Prior Publication Data

US 2013/0101324 A1 Apr. 25, 2013

(30) Foreign Application Priority Data

Oct. 21, 2011 (JP) ..... 2011-231629

(51) Int. Cl.
*G03G 15/20* (2006.01)
*G03G 15/01* (2006.01)

(52) U.S. Cl.
CPC .... *G03G 15/0189* (2013.01); *G03G 2215/0135* (2013.01); *G03G 15/2028* (2013.01)

(58) Field of Classification Search
CPC ..... G03G 15/20; G03G 21/14; G03G 21/00; G03G 15/2085; G03G 2215/00751; G03G 2215/00738; G03G 2215/00742
USPC ..... 399/69, 92, 323, 328, 397, 406, 45
See application file for complete search history.

(56) References Cited

U.S. PATENT DOCUMENTS 3,981,085 A * 9/1976 Franko ..... 399/323
5,098,077 A * 3/1992 Russel
8,139,973 B2 * 3/2012 Ishikawa et al. ..... 399/92
8,195,074 B2 * 6/2012 Ishikawa ..... 399/323
2003/0039491 A1 * 2/2003 Bogoshian ..... 399/323
2008/0165377 A1 * 7/2008 Ishii
2008/0193176 A1 * 8/2008 Roof ..... 399/323
2009/0274493 A1 * 11/2009 Ishikawa et al. ..... 399/323

(Continued)

FOREIGN PATENT DOCUMENTS

JP 3-81791 A 4/1991
JP 2005-128333 A 5/2005

(Continued)

OTHER PUBLICATIONS

Furusawa, Junichi JP 2010169856A Aug. 2010.*

(Continued)

*Primary Examiner* — Susan Lee

(74) *Attorney, Agent, or Firm* — Cantor Colburn LLP

(57) ABSTRACT

The image forming apparatus includes a fixing-side member that comes into contact with an image-formation side of a sheet having a toner image formed thereon by an image forming section; a reverse-side supporting member that comes into contact with a reverse side of the sheet by being pressed toward the fixing-side member; a heat source that supplies heat to the sheet via the fixing-side member; an air separation section that discharges compressed air supplied by an air supply source, to a surface of the fixing-side member to separate the sheet from the fixing-side member; and a control section that controls a pressure accumulation operation in the air supply source. Moreover, the control section disables the pressure accumulation operation in the air supply source in a time period when an image forming process is not performed in the image forming section.

8 Claims, 5 Drawing Sheets

(56) References Cited

U.S. PATENT DOCUMENTS

| | | | | |
|---|---|---|---|---|
| 2011/0182609 | A1* | 7/2011 | Hasegawa et al. | |
| 2012/0308253 | A1* | 12/2012 | Kurata et al. | 399/69 |

FOREIGN PATENT DOCUMENTS

| | | | |
|---|---|---|---|
| JP | 2010-169856 | A | 8/2010 |
| JP | 2011-150242 | A | 8/2011 |

OTHER PUBLICATIONS

Notice of Reasons for Rejection for Japanese Patent Application No. 2011-231629, dispatched Sep. 10, 2013, with English translation.

Japanese Notice of the Reasons for Rejection dispatched Nov. 26, 2013 for the corresponding Japanese Patent Application 2011-231629 with English translation.

* cited by examiner

IMAGE FORMING APPARATUS AND IMAGE FORMING METHOD

CROSS REFERENCE TO RELATED APPLICATIONS

This application is entitled and claims the benefit of Japanese Patent Application No. 2011-231629, filed on Oct. 21, 2011, the disclosure of which including the specification, drawings and abstract is incorporated herein by reference in its entirety.

TECHNICAL FIELD

The present invention relates to an image forming apparatus and an image forming method including an air separation type fixing device for discharging compressed air to a surface of a fixing-side member to separate a sheet from the fixing-side member.

BACKGROUND ART

In general, electrophotographic image forming apparatus (such as printers, copiers and facsimile machines) are configured to irradiate (expose) a charged photoconductor with laser light according to the image data to form thereon an electrostatic latent image, and deposit colored particles, or toner, on the electrostatic latent image, visualizing the electrostatic latent image to form a toner image. The toner image is then directly or indirectly transferred onto a sheet, and heated and pressurized by a fixing device for fixation to form an image on the sheet.

The fixing device includes a fixing-side member (e.g., fixing roller or belt) that comes into contact with an image-formation side of the sheet, and a reverse-side supporting member (e.g., pressing roller or belt) that comes into contact with the reverse side (i.e., the side opposite to the image-formation side) of the sheet by being pressed against the fixing-side member with a predetermined load. The reverse-side supporting member is pressed against the fixing-side member to thereby form a nip portion that holds and carries a sheet.

In such a fixing device, during fixing of the toner image to the sheet, adhesion of melted toner may cause the sheet to wind around the fixing-side member, which may result in fixing failures such as paper jam. Recently, in particular, the diameter of the fixing roller has been increased to secure sufficient nip time for accelerated fixing. In this case, however, the resultant smaller curvature at the exit of the nip portion makes it difficult to separate the sheet.

Consequently, there has been proposed a fixing device that includes an air separation section that blows air toward the leading end of the sheet that has passed through the nip portion, in order to separate the sheet winding around the fixing-side member. A compressor-type air separation section including an air supply source with a compressor (compression machine) has been known (see, e.g., Patent Literature 1). The compressor-type air separation section can blow compressed air at a larger discharge pressure than a fan-type air separation section, and thus can reliably separate the sheet even when a pliable sheet is used or even when the volume of deposited toner is large.

Patent Literature 1 discloses an image forming apparatus configured to disable a compressor (i.e., configured to inhibit the generation of compressed air) during image formation in order to prevent reduction of image quality caused by the compressor's vibration propagated to image forming sections.

CITATION LIST

Patent Literature

PTL 1

Japanese Patent Application Laid-Open No. 2010-169856

SUMMARY OF INVENTION

Technical Problem

In conventional image forming apparatus, a pressure accumulation operation is performed in the compressor so as to keep the pressure in an air tank at a certain level. For example, when the pressure in the air tank has decreased due to an air leak from piping joints or other portions, the pressure accumulation operation is performed until the pressure exceeds a lower limit set value. In other words, the pressure accumulation operation is performed even while an image forming process is not performed. Moreover, since the compressor includes consumable parts, periodic maintenance and inspection are required every time a predetermined cumulative time of the pressure accumulation operation is reached in the compressor. In addition, when the print count is relatively small with respect to a running time of the compressor, it results in increased CPP (image forming cost per sheet) due to increased compressor power consumption required for forming one image and to increased maintenance frequency.

Moreover, an increased frequency of the pressure accumulation operation in the compressor is likely to cause a mechanical problem and a failure in a compressor body (i.e., compressed air generation section) due to an increased temperature associated with air compression, heat generated by a motor, and an increased number of times of operations of a solenoid valve. The failure in the compressor not only reduces the reliability of the image forming apparatus, but also increases the CPP.

It should be noted that, in the image forming apparatus described in Patent Literature 1, while the compressor running time is reduced by not conducting the operation of the compressor during transfer of the toner image, the pressure accumulation operation is still wastefully performed while the image formation is not performed for a long time.

An object of the present invention is therefore to provide a highly reliable image forming apparatus that can reduce the CPP.

Solution to Problem

To achieve at least one of the abovementioned objects, an image forming apparatus reflecting one aspect of the present invention comprises:

a fixing-side member that comes into contact with an image-formation side of a sheet, the sheet having a toner image formed thereon by means of an image forming section;

a reverse-side supporting member that comes into contact with a reverse side of the sheet by being pressed against the fixing-side member;

a heat source for supplying heat to the sheet via the fixing-side member;

an air separation section for discharging compressed air supplied by an air supply source, to a surface of the fixing-side member to separate the sheet from the fixing-side member; and a control section for controlling a pressure accumulation operation in the air supply source, wherein the control section disables the pressure accumulation operation in the air supply source in a time period when an image forming process is not performed in the image forming section.

To achieve at least one of the abovementioned objects, an image forming method reflecting one aspect of the present invention comprises:

a first step of forming a toner image on a sheet by an image forming section;

a second step of holding and pressurizing the sheet between a fixing-side member that comes into contact with an image-formation side of the sheet and a reverse-side supporting member that comes into contact with a reverse side of the sheet, for heating the sheet via the fixing-side member to fix the toner image to the sheet;

a third step of discharging compressed air supplied by an air supply source, to a surface of the fixing-side member to separate the sheet from the fixing-side member; and a fourth step of accumulating a pressure in the air supply source, wherein in the fourth step, a pressure accumulation operation in the air supply source is not performed in a time period when the first step is not performed.

Advantageous Effects Invention

According to the present invention, the pressure accumulation operation in the air supply source (compressor), that is, the running time of the air supply source is minimized. This reduces power consumption and maintenance frequency of the air supply source, and also remarkably reduces the failure frequency. Accordingly, a high-reliable image forming apparatus that can reduce the CPP is provided.

DESCRIPTION OF EMBODIMENTS

An embodiment of the present invention will now be described in detail with reference to the accompanying drawings.

Figure 1:
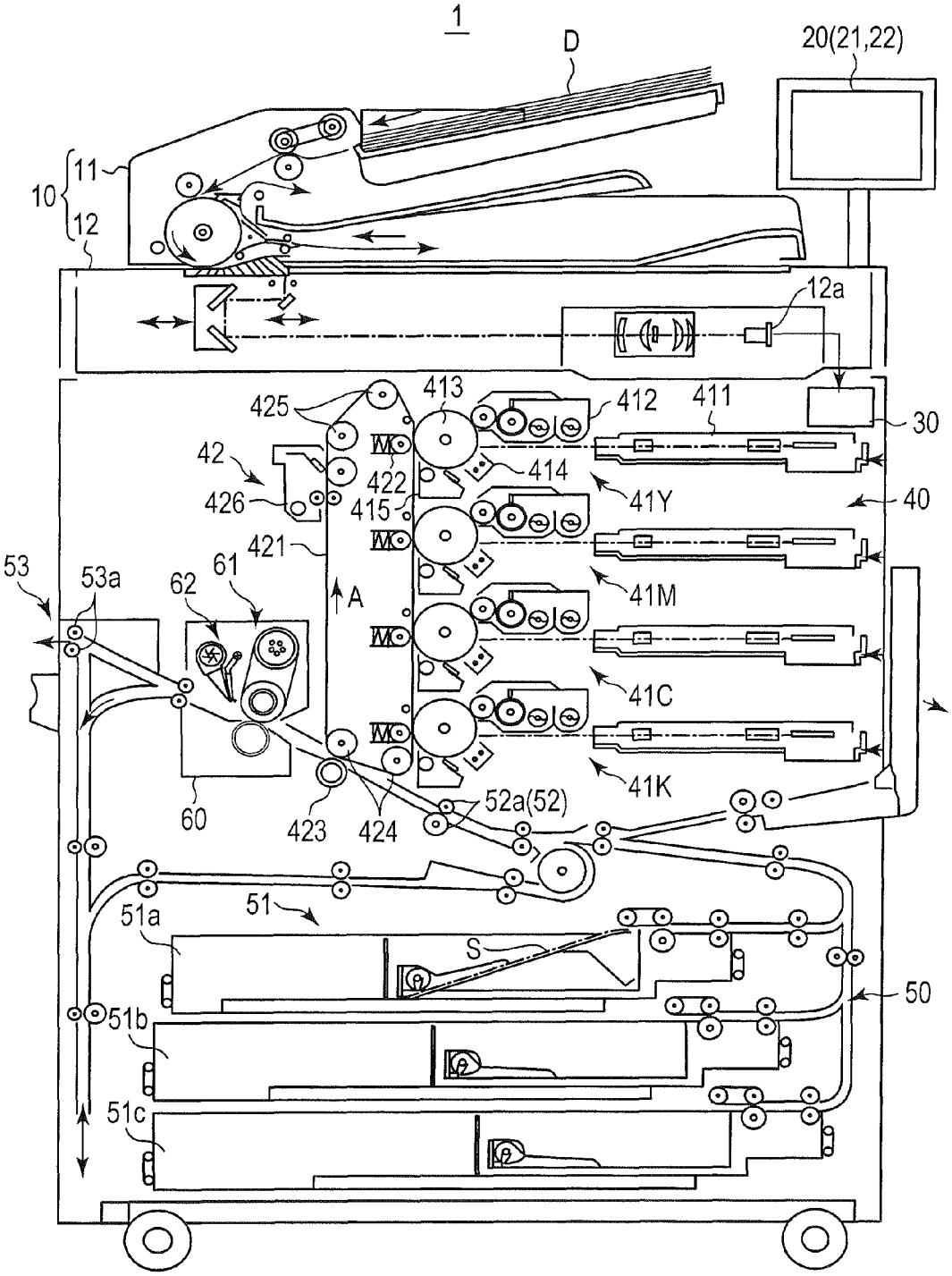
FIG. 1 is a diagram schematically illustrating an overall configuration of an image forming apparatus according to an embodiment of the present invention.
Figure 2:
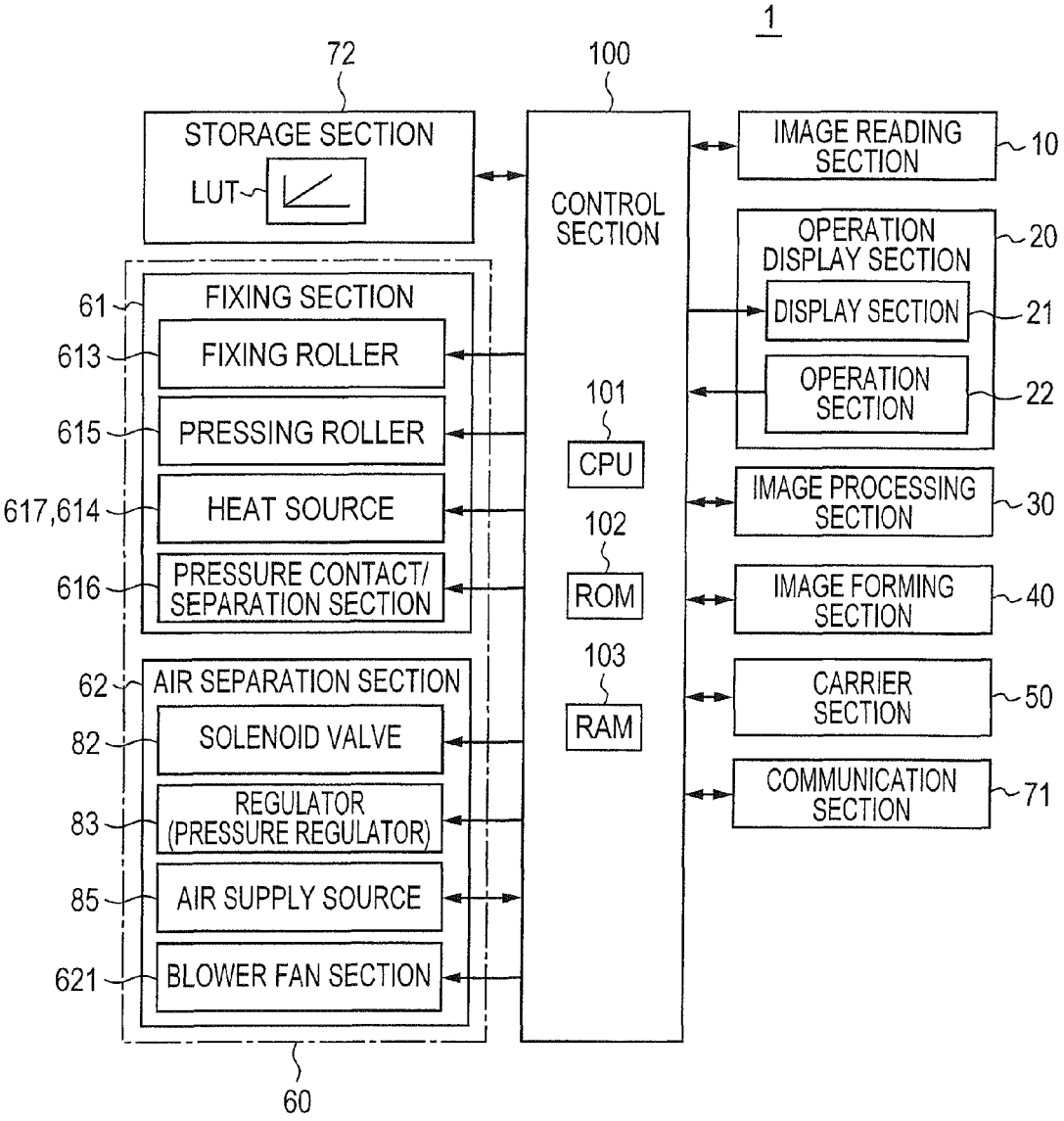
FIG. 2 is a diagram illustrating a major part of a control system of the image forming apparatus according to the embodiment.

FIG. 1 is a diagram schematically illustrating an overall configuration of an image forming apparatus 1 according to the embodiment of the present invention. FIG. 2 is a diagram illustrating a major part of a control system of the image forming apparatus 1 according to the embodiment. The image forming apparatus 1 illustrated in FIGS. 1 and 2 is a color image forming apparatus using an intermediate transfer system using electrophotographic processing technology. In other words, image forming apparatus 1 transfers C (cyan), M (magenta), Y (yellow) and K (black) images formed on respective photoconductor drums 413 onto an intermediate transfer belt 421 so that they are superimposed on the intermediate transfer belt 421 (i.e., primary transfer). Image forming apparatus 1 then transfers the superimposed images onto a sheet to thereby form an image (i.e., secondary transfer). Moreover, image forming apparatus 1 employs a tandem system having photoconductor drums 413 corresponding to four colors CMYK arranged in tandem in the running direction of intermediate transfer belt 421, so that the respective color toner images are sequentially transferred onto intermediate transfer belt 421 in one procedure.

As illustrated in FIGS. 1 and 2, image forming apparatus 1 includes image reading section 10, operation display section 20, image processing section 30, image forming section 40, carrier section 50, fixing section 60 and control section 100.

Control section 100 includes central processing unit (CPU) 101, read only memory (ROM) 102, random access memory (RAM) 103, and the like. CPU 101 reads a program corresponding to content of a process, from ROM 102, expands the program into RAM 103, and controls operations of respective blocks of image forming apparatus 1 in a centralized manner in cooperation with the expanded program, with reference to various data stored in storage section 72. Storage section 72 includes, for example, a nonvolatile semiconductor memory (so-called flash memory) and/or a hard disk drive.

Control section 100 transmits and receives various data to and from an external device (e.g., personal computer) connected to a communication network such as local area network (LAN) or wide area network (WAN) via communication section 71. Control section 100 receives, for example, image data transmitted from the external device, and forms an image on a sheet based on this image data (input image data). Communication section 71 includes, for example, a communication control card such as a LAN card.

Image reading section 10 includes auto document feeding device 11 called auto document feeder (ADF), document image scanning device (scanner) 12, and the like. Auto document feeding device 11 feeds document D placed on a document tray according to a carrying mechanism, and sends out document D to document image scanning device 12. Auto document feeding device 11 can successively read images (including both sides) of many documents D placed on the document tray, at once. Document image scanning device 12 optically scans a document fed from auto document feeding device 11 onto a contact glass, or a document placed on the contact glass, images reflected light from the document onto a light receiving surface of charge coupled device (CCD) sensor 12*a*, and reads a document image. Image reading section 10 generates input image data based on a result of reading by document image scanning device 12. Image processing section 30 applies predetermined image processing to this input image data.

Operation display section 20 includes, for example, a touch-panel liquid crystal display (LCD), and functions as display section 21 and operation section 22. Display section 21 displays various operation screens, the state of the image, the operation status of each function and the like, according to display control signals input from the control section 100. Operation section 22 includes various operation keys such as a numeric keypad and a start key to receive various input operations by a user, and to output operation signals to control section 100.

Image processing section 30 includes a circuit and the like that performs digital image processing for the input image data, depending on default or user settings. Image processing section 30 performs, for example, tone correction based on tone correction data (tone correction table), under control of control section 100. Moreover, image processing section 30 applies various correction processes, such as color correction and shading correction, a compression process and the like to the input image data, in addition to the tone correction. Image forming section 40 is controlled based on such processed image data.

Image forming section 40 includes image forming units 41Y, 41M, 41C and 41K that form images with colored toner for a Y-component, an M-component, a C-component and a K-component, respectively, based on the input image data; intermediate transfer unit 42; and the like.

Image forming units 41Y, 41M, 41C and 41K for the Y-component, the M-component, the C-component and the K-component have similar configurations. For convenience of illustration and explanation, common components are denoted by the same reference numeral, and Y, M, C or K is added to the reference numeral to differentiate each component. In FIG. 1, only components of image forming unit 41Y for the Y-component are assigned reference numerals, which are omitted for components of the other image forming units 41M, 41C and 41K.

Image forming unit 41 includes exposure device 411, development device 412, photoconductor drum 413, charging device 414, drum cleaning device 415, and the like.

Photoconductor drum 413 is, for example, a negative charge-type organic photo-conductor (OPC) having an under coat layer (UCL), a charge generation layer (CGL), and a charge transport layer (CTL) that are sequentially laminated on the circumferential surface of a conductive cylindrical aluminum body (aluminum base pipe).

Charging device 414 evenly negatively charges the photoconductive surface of photoconductor drum 413. The exposure device 411 includes, for example, a semiconductor laser, and emits laser light corresponding to each color-component image, to photoconductor drum 413. Positive charges occur on the charge generation layer on photoconductor drum 413, and are transported to the surface of the charge transport layer so as to neutralize surface charges (negative charges) of photoconductor drum 413. An electrostatic latent image of each color component is formed on the surface of photoconductor drum 413 due to a potential difference from its surroundings.

Development device 412 houses a developer of each color component (e.g., a two-component developer containing small-diameter toner and a magnetic carrier), and causes the toner of each color component to adhere to the surface of photoconductor drum 413 so as to visualize the electrostatic latent image and form the toner image. Drum cleaning device 415 has a drum cleaning blade to be brought into sliding contact with the surface of photoconductor drum 413. Residual toner remaining on the surface of photoconductor drum 413 after the primary transfer is scraped off and removed by the drum cleaning blade.

Intermediate transfer unit 42 includes intermediate transfer belt 421, which is an intermediate image transferring member, primary transfer rollers 422, secondary transfer roller 423, drive rollers 424, driven rollers 425, belt cleaning device 426, and the like.

Intermediate transfer belt 421 is composed of an endless belt, which is wrapped around drive rollers 424 and driven rollers 425. Intermediate transfer belt 421 runs at a constant rate in the direction of arrow A, according to the rotation of drive rollers 424. When intermediate transfer belt 421 is pressed against photoconductor drums 413 by primary transfer rollers 422, the respective color toner images are sequentially transferred on intermediate transfer belt 421 in a superimposed manner (i.e., primary transfer). While sheet S passes through a nip portion (i.e., transfer nip) which is formed by secondary transfer roller 423 being pressed against intermediate transfer belt 421, the superimposed toner image on intermediate transfer belt 421 is transferred onto sheet S (i.e., secondary transfer). Belt cleaning device 426 has a belt cleaning blade to be brought into sliding contact with the surface of intermediate transfer belt 421. Residual toner remaining on the surface of intermediate transfer belt 421 after the secondary transfer is scraped off and removed by the belt cleaning blade.

Fixing section 60 heats and pressurizes carried sheet S at a nip portion (fixing nip) N, and thereby fixes the toner image to sheet S. In the present embodiment, an air separation type fixing device including fixing unit 61 and air separation unit 62 is employed as fixing section 60. Fixing unit 61 and air separation unit 62 are housed in a housing case so as to be isolated from other components of image forming apparatus 1, in order to maintain a stable temperature of fixing belt 611. A detailed configuration of fixing section 60 will be described later.

Carrier section 50 includes sheet feeding section 51, carrying mechanism 52, sheet ejection section 53, and the like. Different sets of sheets S (e.g., standard sheets and special sheets), which have been identified based on their basis weight, size, etc., are housed in three different sheet feeding tray units 51*a* to 51*c* of sheet feeding section 51.

Sheets S housed in the sheet feeding tray units 51*a* to 51*c* are sent out one by one from top, and carried to image forming section 40 by carrying mechanism 52 including multiple carrier rollers such as registration rollers 52*a*. At this point, the tilt of fed sheet S is corrected and carrying timing is adjusted by a registration section in which registration rollers 52*a* are disposed. Next, in image forming section 40, the superimposed toner image on intermediate transfer belt 421 is transferred at one time on one side (i.e., image-formation side) of the sheet S (i.e., secondary transfer), and subjected to a fixing process in fixing section 60. In other words, the image forming process includes forming of a toner image on the sheet S. Sheet S having an image formed thereon is ejected to the outside by sheet ejection section 53 including ejection rollers 53*a*.

Figure 3:
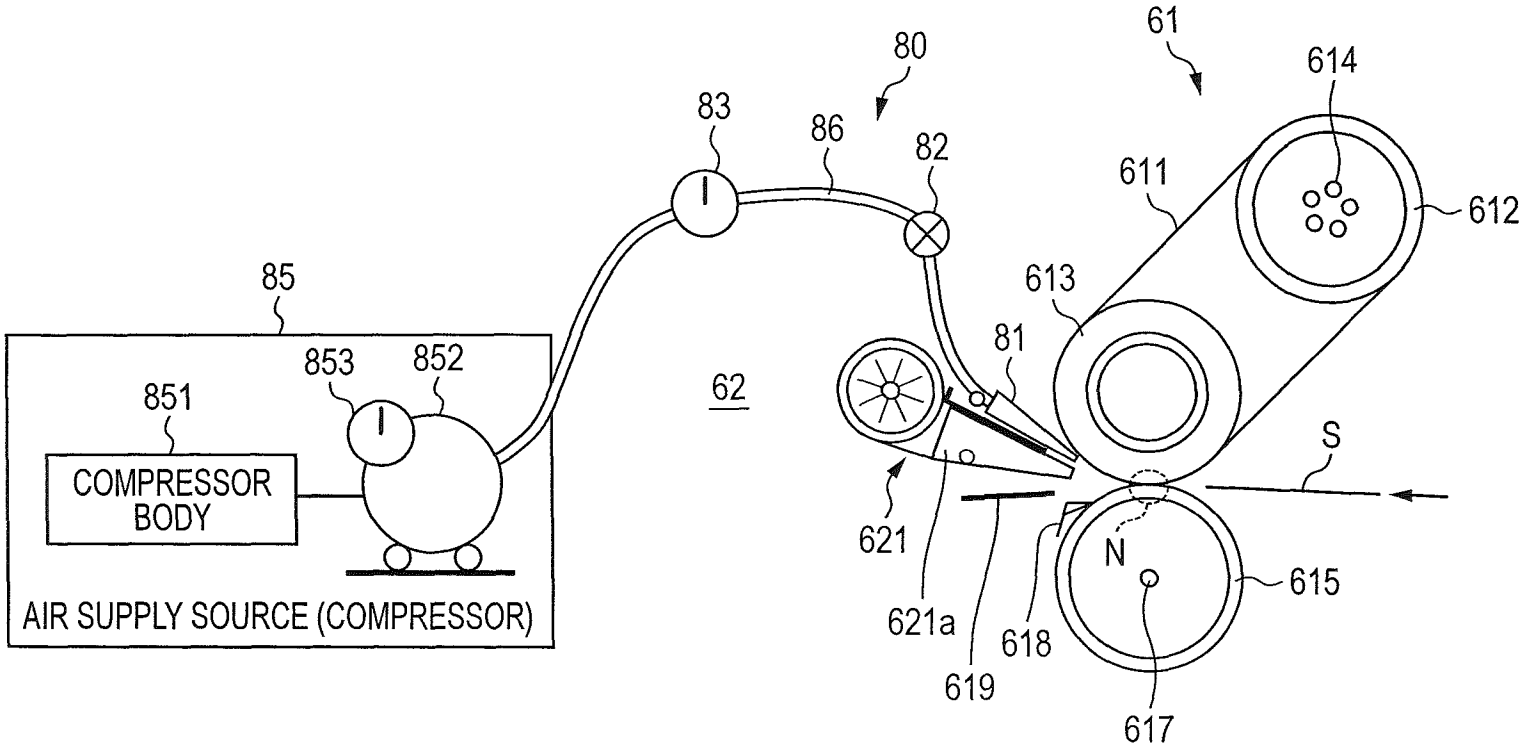
FIG. 3 is a diagram illustrating a configuration of a fixing section according to the embodiment.

FIG. 3 is a diagram illustrating an example of fixing section 60. As illustrated in FIG. 3, fixing section 60 includes fixing unit 61 for fixing the toner image to sheet S, and air separation unit 62 for separating sheet S from a fixing-side member.

Fixing unit 61 is a fixing unit to which a so-called belt heating system has been applied, and has an upper pressure portion including endless fixing belt 611 wrapped around heating roller 612 and fixing roller 613 at a predetermined belt tension (e.g., 200 N), and a lower pressure portion including pressing roller 615. Pressing roller 615 is pressed against fixing roller 613 through fixing belt 611 with a predetermined fixing load (e.g., 2,000 N), so as to form nip portion N that holds and carries sheet S.

In the present embodiment, fixing belt 611 is the fixing-side member that comes into contact with the image-formation side of sheet S, and pressing roller 615 is a reverse-side supporting member to be pressed against fixing belt 611, which is the fixing-side member, so as to come into contact with the reverse side of sheet S (i.e., the side opposite to the image-formation side).

Fixing belt 611 comes into contact with sheet S having a toner image formed thereon, to heat sheet S at a fixing temperature (e.g., 160° C. to 200° C.). The fixing temperature is a temperature that can supply an amount of heat required to melt the toner on sheet S, and varies depending on the sheet type or the like of the sheet to be used for the image formation. Fixing belt 611 includes, for example, an elastic layer made of silicone rubber or the like (e.g., 200 μm in thickness and 15° in JIS-A hardness) laminated on the outer circumferential surface of a heat-resistant polyimide film base material (e.g., 70 μm in thickness), and a surface layer made of fluorine resin such as PFA (perfluoroalkoxyalkane) or PTFE (polytetrafluoroethylene), further laminated on the outer circumferential surface of the elastic layer.

Heating roller 612 heats fixing belt 611 so that sheet S may be heated at the fixing temperature by fixing belt 611, that is, the temperature of fixing belt 611 may become the fixing temperature. Heating roller 612 includes, for example, a resin layer made of PTFE or the like formed on the outer circumferential surface of a cylindrical core metal of aluminum or the like.

Heat source 614 such as a halogen heater is included in heating roller 612. Output of heat source 614 is controlled by control section 100. Heating roller 612 is heated by heat source 614, which results in fixing belt 611 being heated. It should be noted that fixing belt 611 may be heated by induction heating (IH).

Fixing roller 613 includes, for example, an elastic layer made of silicone rubber or the like (e.g., 17 mm in thickness and 10° in JIS-A hardness), and a surface layer made of fluorine resin such as PTFE (e.g., 50 μm in thickness), which are sequentially laminated on the outer circumferential surface of a columnar core metal made of iron or the like (e.g., 56 mm in outer diameter). Drive of fixing roller 613 (e.g., rotation on/off and the number of rotations) is controlled by control section 100.

Pressing roller 615 includes, for example, an elastic layer made of silicone rubber or the like (e.g., 2 mm in thickness and 10° in JIS-A hardness), and a surface layer formed of a PFA tube (e.g., 30 μm in thickness), which are sequentially laminated on the outer circumferential surface of a columnar core metal made of iron or the like (e.g., 86 mm in outer diameter). Pressing roller 615 is pressed against fixing roller 613 through fixing belt 611 by pressing-separation section 616. Drive of pressing roller 615 (e.g., rotation on/off and the number of rotations) and drive of pressing-separation section 616 are controlled by control section 100.

Heat source 617 such as a halogen heater is included in pressing roller 615. A predetermined temperature (e.g., 80° C. to 120° C.) of pressing roller 615 is maintained by heat source 617 in order to limit a decrease in the temperature of fixing belt 611 (i.e., inhibit heat dissipation from fixing belt 611) in pressure contact. Moreover, because image quality deteriorates when the temperature of pressing roller 615 is too high, a cooling mechanism with a fan or the like may be provided. Output of heat source 617 is controlled by control section 100.

Moreover, separating claws 618 and sheet ejection guide plate 619 are arranged on a sheet ejection side of nip portion N. Multiple (e.g., six) separating claws 618 are arranged in contact with the pressing roller 615, which is the reverse-side supporting member, along the axial direction of pressing roller 615. Each of the separating claws 618 is a claw member made of heat-resistant resin (e.g., 10 mm in claw width), and a surface layer made of fluorine resin such as PFA or PTFE is formed on the surface of the claw member. While a contact pressure of separating claw 618 against pressing roller 615 depends on a relationship among the claw width, a claw material, and a surface material of pressing roller 615, any contact pressure may be set so that pressing roller 615 may not be damaged. Separating claws 618 separate sheet S sticking to pressing roller 615, from the roller, and guide sheet S to sheet ejection guide plate 619. It should be noted that since the temperature of pressing roller 615 is maintained to a level at which toner may not melt (e.g., 80° C. to 120° C.), separating claws 618 do not generate lines and other image defects even on an image formed on the reverse side of the sheet S (i.e., side in contact with pressing roller 615).

Sheet ejection guide plate 619 is a carrier path through which sheet S from fixing section 60 is ejected. Many ribs or small rollers are arranged in sheet ejection guide plate 619 in parallel with the sheet carrying direction, in order to prevent sheet S from sticking to the plate and causing poor sheet ejection.

air separation unit 62 includes blower fan section 621 and compressed air discharge section 80. Each of blower fan section 621 and compressed air discharge section 80 blows air toward a previously set point to which air is blown (e.g., a predetermined position from the sheet ejection side end of the nip portion N (nip end), along the circumferential direction of fixing roller 613).

Blower fan section 621 includes, for example, a cylindrical multi-blade fan (so-called sirocco fan) having many blades facing forward and standing circumferentially. Blower fan section 621 has air blower duct **621*a* having a blower opening formed in parallel with the axial direction of fixing roller 613. Multiple air blower ducts 621*a* may be provided side by side in the axial direction of fixing roller 613**.

Blower fan section 621 continuously blows air from air blower duct **621*a* toward the surface of fixing belt 611 uniformly across the width of fixing belt 611. Fine control of rotation on/off of the fan leads to an unstable air volume, and rather may adversely affect the separation of sheet S. Accordingly, blower fan section 621 continuously blows air at a constant wind speed (e.g., 20 m/s) until the end of a series of image forming processes. A timing of blow by blower fan section 621 (the rotation on/off of the fan), an air volume (the number of rotations of the fan) and the like are controlled by control section 100**.

Compressed air discharge section 80 includes air discharge nozzle 81, solenoid valve 82, regulator 83 and air supply source 85, all of which are connected via air supply flow path 86.

Air discharge nozzle 81 has a discharge opening formed in parallel with the axial direction of fixing roller 613, and is arranged so that air is blown toward a predetermined separation point. Many tiny discharge holes are formed as the discharge opening of air discharge nozzle 81. Multiple air discharge nozzles 81 may be provided side by side in the axial direction of fixing roller 613. Moreover, air discharge nozzle 81, for example, may be connected to an actuator (not shown) so that the conditions of air blow (e.g., blow direction and/or blow position) can be changed. Air discharge nozzle 81 discharges compressed air toward the surface of fixing belt 611 uniformly across the width of fixing belt 611.

Solenoid valve 82 is arranged upstream of air discharge nozzle 81. Solenoid valve 82 is an on/off valve that opens and closes air supply flow path 86 so as to discharge compressed air from air discharge nozzle 81 at a predetermined timing. Solenoid valve 82 is usually in a closed state, and is switched to an open state at a timing when the leading end of sheet S comes out from nip portion N. Opening/closing of solenoid valve 82 is controlled by control section 100. For example, with reference to a time point when the leading end of sheet S has been detected by a sheet detection section (not shown) provided in a preceding stage of nip portion N (e.g., secondary transfer region), the timing when the leading end of sheet S comes out from nip portion N, that is, the timing when solenoid valve 82 is put into the open state, is calculated.

Regulator (pressure regulator) 83 is arranged between solenoid valve 82 and air supply source 85. Regulator 83 regulates a pressure downstream of regulator 83 to a level suitable for use. The arrangement of regulator 83 between solenoid valve 82 and air supply source 85 enables easy control of a discharge amount and a discharge pressure of the compressed air to be discharged from air discharge nozzle 81.

Moreover, the regulated pressure to be provided by regulator 83 is set by control section 100. Specifically, control section 100 sets the regulated pressure to be provided by regulator 83, depending on the sheet type (such as size, basis weight and sheet thickness) of the sheet to be used for the image formation. This is because, in the fixing process, the discharge pressure of the compressed air required to separate sheet S from fixing belt 611 varies depending on the sheet type of sheet S to be used for the image formation. For example, when a thin, pliable sheet is used, the discharge of the compressed air at a strong discharge pressure is required to separate sheet S from fixing belt 611. In contrast, when a sheet with a certain thickness is used, sheet S can be separated from fixing belt 611 by the discharge of the compressed air only at a weak discharge pressure (or even without the discharge of the compressed air, depending on the sheet type). Further, because plain paper is more rigid (firmer) compared to coated paper of the same weight basis, plain paper can reduce the discharge pressure of compressed air compared to the case where coated paper is used.

By way of example, when using air discharge nozzle 81 having discharge holes with a diameter 0.6 mm formed at pitches of 5 mm, sheet S was able to be reliably separated from fixing belt 611 by setting the regulated pressure to be provided by regulator 83, as shown in Table 1.

TABLE 1

| Basis weight ($g/m^2$) | 80 | 100 | 128 | 163~ |
|---|---|---|---|---|
| Regulated pressure (MPa) | 0.10 | 0.08 | 0.06 | 0 (No discharge) |

Air supply source 85 is composed of, for example, a compressor (compression machine) capable of compressing introduced air at a compression ratio of two or more through a pressure accumulation operation. Specifically, air supply source 85 includes compressor body 851, air tank 852, pressure sensor 853, and the like. Upon mounting of air supply source 85 into image forming apparatus 1, anti-vibration measures are desirably taken, e.g., placement of air supply source 85 through an anti-vibration rubber. This is in order to prevent deterioration of image quality caused by vibration propagated to image forming section 40 due to the pressure accumulation operation in air supply source 85.

In image forming apparatus 1, when control section receives an instruction signal for image formation, control section 100 starts to supply power to air supply source 85 to enable the pressure accumulation operation in air supply source 85. The instruction signal for image formation is, for example, a signal to be output when the user has instructed to perform the image formation, through operation section 22 (e.g., depressing a copy button), or a signal to be output when a signal instructing to perform the image formation for a print job or the like has been received from a PC or a print server on a network, via communication section 71.

Compressor body 851 is, for example, a compressed air generation section having a compression chamber, a piston reciprocates in the compression chamber to compress air, a motor for allowing the piston to reciprocate, and the like (all of which are not shown). Compressor body 851 compresses air introduced through an air intake, to generate high pressure air, and sends out the generated, compressed air to air tank 852.

Air tank 852 is a pressure vessel that retains the compressed air sent out from compressor body 851. A small pressure vessel (e.g., a pressure vessel with the volume of 2 L or less), which enables completion of the pressure accumulation operation in a short time, is suitable as air tank 852.

Pressure sensor 853 detects a pressure of air retained in air tank 852, and also controls on/off of compressor body 851 based on the detected pressure (so-called pressure switch). When the pressure in air tank 852 reaches an upper limit set pressure (e.g., 0.3 MPa), a contact in pressure sensor 853 opens to block an electrical circuit of compressor body 851. Accordingly, the operation of compressor body 851 automatically stops. Moreover, when the pressure in air tank 852 reaches a lower limit set pressure (e.g., 0.2 MPa), the contact in pressure sensor 853 closes to put the electrical circuit of compressor body 851 into a closed state. Accordingly, compressor body 851 operates again to generate compressed air. Thereby, the pressure in air tank 852 is kept at a certain level within a range from the lower limit set pressure to the upper limit set pressure.

It should be noted that the lower limit set pressure in air tank 852 is set higher than the pressure required in image forming apparatus 1 (i.e., regulated pressure to be provided by regulator 83 so that the compressed air is discharged to the leading end of sheet S at a predetermined discharge pressure). In other words, similarly to the regulated pressure to be provided by regulator 83, the lower limit set pressure is set by control section 100, depending on the sheet type (such as size, basis weight and sheet thickness) of the sheet to be used for image formation. The lower limit set pressure of air tank 852, for example, may be set to be 20% or higher than the regulated pressure to be provided by the regulator 83. Thereby, the pressure accumulation operation in compressor body 851 can be minimized. This reduces power consumption and maintenance frequency of the compressor, and also remarkably reduces the failure frequency.

In air supply source 85, when compressor body 851 performs the pressure accumulation operation, the compressed air is generated and retained in air tank 852. Moreover, the on/off control of compressor body 851 is performed by pressure sensor 853 so that the pressure in air tank 852 is kept at a certain level. When the volume of air tank 852 is 2 L and the air discharging rate of compressor body 851 is 20 L/min, a time required to accumulate the pressure in air tank 852, which has been depressurized to the atmospheric pressure, to 0.3 MPa is ten and several seconds. Accordingly, even if the pressure accumulation operation in air supply source 85 is started after an image forming instruction is issued, the time it takes for the first image formation is made possible is only slightly reduced.

The compressed air retained in air tank 852 is constantly supplied to the body of image forming apparatus 1 and is regulated to be kept at a certain level by regulator 83. Then, a predetermined amount of this compressed air is discharged from air discharge nozzle 81 at the predetermined discharge pressure, according to opening/closing operations of solenoid valve 82. Specifically, control section 100 outputs an open signal (i.e., a signal for putting the solenoid valve 82 into open state) to solenoid valve 82 at a timing suitable for the timing when the leading end of sheet S comes out from nip portion N. For example, when solenoid valve 82 takes 20 ms to transit from closed state to open state, control section 100 outputs the open signal to solenoid valve 82, 20 ms earlier than the timing when the leading end of sheet S comes out from nip portion N.

Thereby, the compressed air is discharged at the maximum discharge pressure at the timing when the leading end of sheet S comes out from nip portion N.

Moreover, control section 100 outputs a close signal (i.e., a signal for putting solenoid valve 82 into closed state), for example, at 60 ms after outputting the open signal to solenoid valve 82, and causes solenoid valve 82 to transit to closed state so as to be ready for the separation of next sheet S. Since the compressed air is discharged in order to separate the leading end of sheet S from fixing belt 611, a discharge time may be an instant. When the image formation is performed at 100 ppm (Paper per Minute), a time required for one sheet is 0.6 s. This means that solenoid valve 82 is driven for 60 ms at every 0.6 s, at a duty of about 10%. In such a case, a small air supply source with the size and the power consumption on the order of 1/10 of a conventional one is applicable as air supply source 85.

In fixing section 60, sheet S, which has passed through nip portion N of fixing unit 61, is separated from fixing belt 611 as follows. In other words, firstly, the compressed air is discharged from the compressed air discharge section 80 toward the leading end of sheet S, and thereby the leading end portion of sheet S is separated from fixing belt 611. A gap between the leading end of sheet S and fixing belt 611 is only about 0.1 mm, which means that the separation of sheet S requires a large wind pressure (i.e., the regulated pressure to be provided by regulator 83 of 0.1 MPa or more (in the case of a sheet with the basis weight of 80 g/m$^2$)). Hence, the compressed air is first discharged to separate the leading end of sheet S.

Secondly, air is blown between sheet S and fixing belt 611 by blower fan section 621 so as to separate the entire sheet S from fixing belt 611. After the leading end of sheet S is separated, the gap between sheet S and fixing belt 611 is widened so that the separation is enabled even by the wind pressure from the fan. As the separation of sheet S proceeds to some degree and the leading end opens at 0.2 mm or more, an air flow with a large air volume is rather advantageous because it can uniformly apply peel force to the entire open area.

Sheet S separated from fixing belt 611 is carried while being pressed by air toward the pressing roller 615. Then, sheet S is separated from pressing roller 615 by separating claws 618, and output from fixing section 60 by sheet ejection guide plate 619.

According to air separation unit 62, sheet S can be efficiently separated from fixing belt 611. Moreover, since the amount of the compressed air to be discharged from compressed air discharge section 80 can be reduced, air supply source 85 can be downsized.

When the pressure accumulation operation in air supply source 85 is made possible at any time as is in the conventional apparatus, the pressure accumulation operation is performed even if an air leak has occurred thus reducing the pressure in air tank 852 while the image formation has not been performed for a long time. Since the lifetime of air supply source 85 depends on its running time (i.e., the frequency of the pressure accumulation operation), it is desirable to perform as few pressure accumulation operations as possible. In the present embodiment, control section 100 controls whether to supply power to air supply source 85 to enable the pressure accumulation operation, or to block the power supply to disable the pressure accumulation operation, based on a state of the image forming process in image forming apparatus 1.

Figure 4:
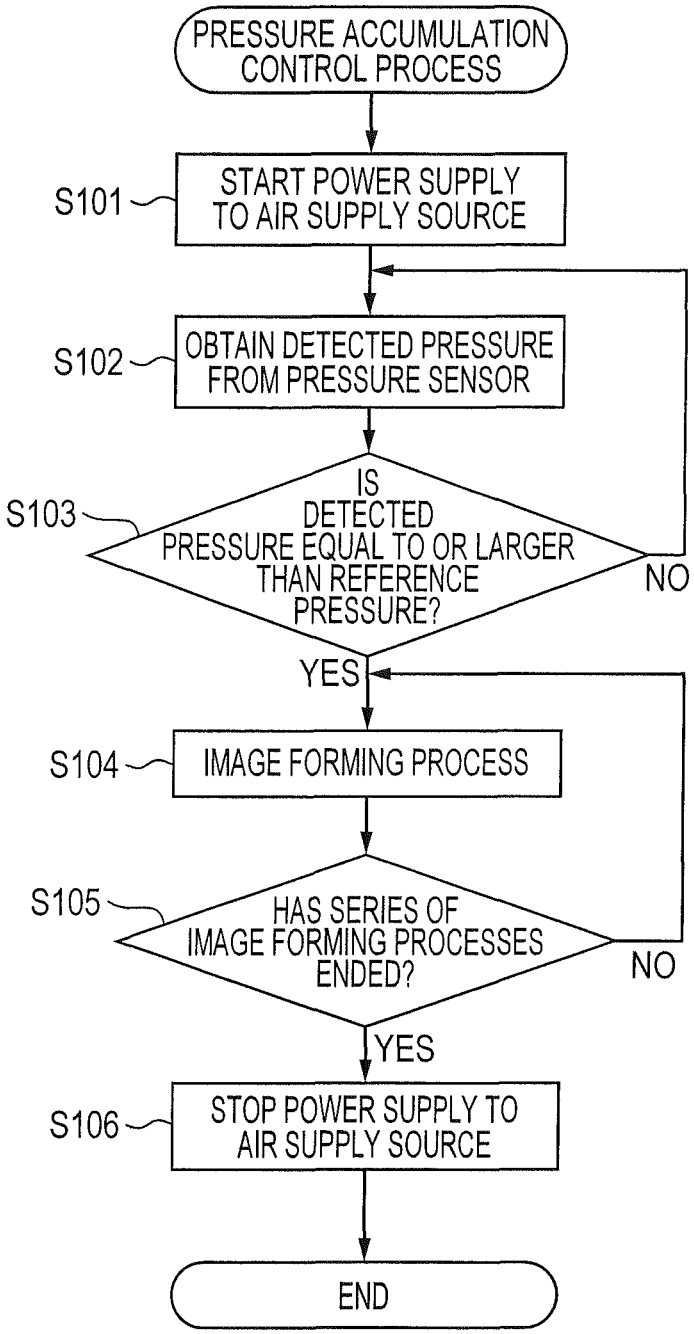
FIG. 4 is a flowchart illustrating an example of a pressure accumulation control process.
Figure 5:
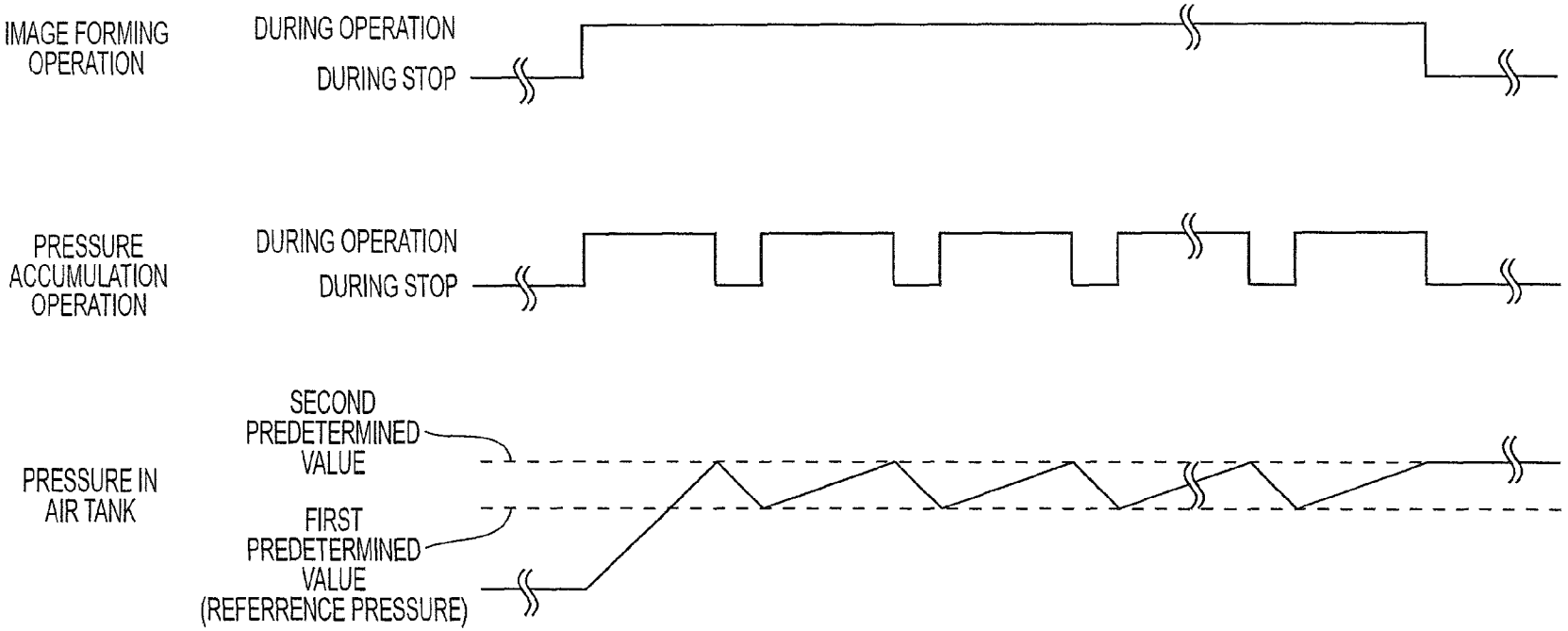
FIG. 5 is a timing chart illustrating an example of a pressure accumulation control process.

FIG. 4 is a flowchart illustrating an example of a pressure accumulation control process. The pressure accumulation control process illustrated in FIG. 4, for example, is realized by CPU 101 executing a predetermined program stored in ROM 102 in response to the input of the instruction signal for image formation into control section 100 in image forming apparatus 1. A timing chart of the pressure accumulation control process is shown in FIG. 5.

In step S101, control section 100 starts the power supply to air supply source 85 to enable the pressure accumulation operation. In other words, even if image forming apparatus 1 is powered on, power is not immediately supplied to air supply source 85, and power is first supplied to air supply source 85 after the image forming instruction is issued. In air supply source 85, as shown in FIG. 5, the pressure accumulation operation is performed until the pressure in air tank 852 reaches the upper limit set pressure (i.e., second predetermined value). If the pressure in air tank 852 has not returned to the atmospheric pressure, the accumulation of the pressure into air tank 852 is completed in a very short time.

In step S102, control section 100 obtains the detected pressure from pressure sensor 853.

In step S103, control section 100 determines whether or not the detected pressure obtained in step S102 is equal to or larger than the reference pressure. The reference pressure herein is a lower limit set pressure (i.e., first predetermined value) that becomes a criterion for determination of whether or not an appropriate discharge amount of the compressed air can be discharged at an appropriate discharge pressure in the fixing process. The reference pressure is set to a value almost equivalent to the regulated pressure to be provided by regulator 84. Then, when control section 100 determines that the detected pressure is equal to or larger than the reference pressure, control section 100 can determine that sufficient compressed air is being supplied by air supply source 85, and thus proceeds to a process in step S104. Air supply source 85 stops the pressure accumulation operation at the time when the pressure in air tank 852 has reached the second predetermined value. In contrast, when control section 100 determines in step S103 that the detected pressure is less than the reference pressure, it means that the sufficient compressed air is not being supplied by air supply source 85, and thus control section 100 returns to a process in step S102 and repeats processes in step S102 and S103 until the detected pressure provided by pressure sensor 853 becomes equal to or larger than the reference pressure. It should be noted that when the detected pressure does not become equal to or larger than the reference pressure even after a predetermined time has elapsed, compressor body 851 is likely to be malfunctioning, and thus such a state may be displayed on display section 21 so as to end the pressure accumulation control process illustrated in FIG. 4.

In step S104, control section 100 starts the image forming process (the supply of sheet S from sheet feeding section 51). Since the image forming process is started after the detected pressure has become equal to or larger than the reference pressure, poor separation of sheet S due to lack of the discharge pressure of the compressed air can be reliably prevented in the fixing process. Moreover, when the image forming process has started, compressed air is discharged from compressed air discharge section 80, resulting in a gradual decrease in the pressure in air tank 852. Accordingly, a pressure accumulation operation is appropriately performed in air supply source 85. More specifically, as shown in FIG. 5, air supply source 85 starts a pressure accumulation operation at the time when the pressure in air tank 852 has reached the first predetermined value, and stops the pressure accumulation operation at the time when the pressure in air tank 825 has reached the second predetermined value.

It should be noted that, in step S103, even if the detected pressure obtained in step S102 is lower than the reference pressure but is recoverable to the reference pressure until sheet S arrives at nip portion N, the image forming process may be started. In other words, the image forming process may be started as long as the detected pressure provided by pressure sensor 853 becomes equal to or larger than the reference pressure before the sheet arrives at nip portion N.

In step S105, control section 100 determines whether or not the series of image forming processes has ended. In the case of one print job, the end of the last image forming process specified in the print job is regarded as the end of the series of image forming processes. In the case of multiple print jobs, the end of the last image forming process specified in the last print job is regarded as the end of the series of image forming processes. Even before the series of image forming processes actually ends, if it can be determined that the pressure has been accumulated in air tank 852 to the extent that the discharge pressure of the compressed air is maintained in the fixing process for several sheets before the end, that time point may be regarded as a substantial end of the series of image forming processes. Then, when control section 100 determines that the series of image forming processes has ended, control section 100 proceeds to a process in step S106. When control section 100 determines that the series of image forming processes has not ended, control section 100 returns to the process in step S104 and continues the image forming processes.

In step S106, control section 100 blocks the power supply to air supply source 85 to disable the pressure accumulation operation. Since the pressure accumulation operation in air supply source 85 is disabled, the pressure accumulation operation is not performed even if an air leak occurs from a joint portion and reduces the pressure in air tank 852 while image forming apparatus 1 is left unattended without the image forming process being performed for a long time.

Thus, image forming apparatus 1 includes fixing belt 611 (fixing-side member) that comes into contact with the image-formation side of sheet S having the toner image formed thereon by means of image forming section 40; pressing roller 615 (reverse-side supporting member) that comes into contact with the reverse side of sheet S by being pressed against fixing belt 611; heat source 614 for supplying heat to sheet S via fixing belt 611; compressed air discharge section 80 (air separation section) for discharging the compressed air supplied by air supply source 85, to the surface of fixing belt 611 to separate sheet S from fixing belt 611; and control section 100 that controls the pressure accumulation operation in air supply source 85. In addition, control section 100 disables the pressure accumulation operation in air supply source 85 in a time period when the image forming process is not performed in image forming section 40. Thus, because the image forming process includes forming of a toner image on the sheet S, it respectfully follows that control section 100 disables the pressure accumulation operation in air supply source 85 in a time period when the forming of the toner image is not performed.

Specifically, control section 100 enables the pressure accumulation operation in air supply source 85 in response to reception of the image forming instruction (in step S101 of FIG. 4), and disables the pressure accumulation operation in the air supply source in response to the end of the series of image forming processes (in step S106 of FIG. 4).

According to image forming apparatus 1, the pressure accumulation operation in air supply source 85 (compressor), that is, the running time of air supply source 85 is minimized. This reduces the power consumption and the maintenance frequency of air supply source 85, and also remarkably reduces the failure frequency. Accordingly, image forming apparatus 1 that is highly reliable and can reduce CPP is provided.

While the invention made by the present inventor has been specifically described above based on the embodiment, the present invention is not limited to the above embodiment, and can be changed within a range not deviating from the spirit and scope of the present invention.

For example, air supply source 85 is not limited to that described in the present embodiment, and a common air supply source that is commercially available as an air supply source is applicable. For example, when the pressure in air tank 852 becomes the upper limit set pressure, the compression chamber may be opened to cause compressor body 851 to idle, and when the pressure in air tank 852 becomes the lower limit set pressure, the compression chamber may be closed to cause compressor body 851 to perform a compression operation. Moreover, air supply source 85 may automatically open a release value when the pressure in air tank 852 becomes the upper limit set pressure. Furthermore, when the discharge pressure of the compressed air to be required in the image formation is equal to or less than 0.15 MPa, an electromagnetic pump is also applicable as air supply source 85.

This embodiment is directed to fixing unit 61 that employs belt heating. However, fixing unit 61 is not limited to this particular type. For example, fixing unit 61 may be a fixing unit that employs roller heating. Blower fan section 621 may not be provided in separation unit 62.

Moreover, even after the image forming instruction has been issued to image forming apparatus 1, if it is predicted that the image forming process is not performed for a long time due to the occurrence of a trouble such as a jam, the pressure accumulation operation in air supply source 85 may be disabled. In this case, control section 100 can determine whether or not the image formation is being performed, for example, based on a sheet feed signal from the sheet feeding section 51.

The embodiment disclosed herein should be considered illustrative and not restrictive in all respects. The scope of the present invention is indicated by the claims rather than the above description. It is intended that all modifications within meaning and a scope equivalent to claims are included in the scope of the present invention.

REFERENCE SIGNS LIST

1 image forming apparatus
10 image reading section
20 operation display section
30 image processing section
40 image forming section
50 carrier section
60 fixing section
61 fixing unit
611 fixing belt
612 heating roller
613 fixing roller
614 heat source
615 pressing roller
616 pressing-separation section
617 heat source
618 separating claw
619 sheet ejection guide plate
62 air separation unit
621 blower fan section
80 compressed air discharge section

81 air discharge nozzle
82 solenoid valve
83 regulator
85 air supply source
851 compressor body
852 air tank
853 pressure sensor
86 air supply flow path
100 control section

The invention claimed is:

1. An image forming apparatus, comprising:

a fixing-side member that comes into contact with an image-formation side of a sheet having a toner image formed thereon by means of an image forming section;

a reverse-side supporting member that comes into contact with a reverse side of the sheet by being pressed against the fixing-side member;

a heat source for supplying heat to the sheet via the fixing-side member;

an air separation section for discharging compressed air supplied by an air supply source, to a surface of the fixing-side member to separate the sheet from the fixing-side member; and a control section for controlling a pressure accumulation operation in the air supply source, wherein the control section enables the pressure accumulation operation in the air supply source in a time period when an image forming process is performed in the image forming section, performs the pressure accumulation operation according to a pressure of compressed air in the air supply source in a state where the pressure accumulation operation is enabled, and disables the pressure accumulation operation in the air supply source regardless of the pressure of compressed air in the air supply source in a time period when an image forming process is not performed in the image forming section.

2. The image forming apparatus according to claim 1, wherein the control section enables the pressure accumulation operation in the air supply source in response to reception of an image forming instruction, and disables the pressure accumulation operation in the air supply source in response to an end of a series of image forming processes.

3. The image forming apparatus according to claim 1, further comprising:

a pressure detection section for detecting a pressure of the compressed air accumulated in the air supply source, wherein the image forming process is performed by means of the image forming section after the pressure detected by the pressure detection section rises above a predetermined pressure value.

4. The image forming apparatus according to claim 1, wherein the control section changes a pressure of the compressed air to be accumulated in the air supply source, depending on a sheet type of a sheet to be used for image formation.

5. An image forming method, comprising:

forming a toner image on a sheet by means of an image forming section;

holding and pressurizing the sheet between a fixing-side member that comes into contact with an image-formation side of the sheet and a reverse-side supporting member that comes into contact with a reverse side of the sheet, for heating the sheet via the fixing-side member to fix the toner image to the sheet;

discharging compressed air supplied by an air supply source, to a surface of the fixing-side member to separate the sheet from the fixing-side member; and controlling a pressure accumulation operation in the air supply source, wherein the controlling of the pressure accumulation operation comprises:

enabling the pressure accumulation operation in the air supply source in a time period when the forming of the toner image is performed, and performing the pressure accumulation operation according to a pressure of compressed air in the air supply source in a state where the pressure accumulation operation is enabled; and disabling the pressure accumulation operation in the air supply source in a time period when the forming of the toner image is not performed.

6. The image forming method according to claim 5, wherein the enabling of the pressure accumulation operation in the air supply source is performed in response to reception of an image forming instruction, and the disabling of the pressure accumulation operation in the air supply source is performed in response to an end of a series of image forming processes.

7. The image forming method according to claim 5, wherein the forming of the toner image is performed after a pressure of the compressed air accumulated in the air supply source rises above a predetermined pressure value.

8. The image forming method according to claim 5, wherein in the controlling of the pressure accumulation operation, a pressure of the compressed air to be accumulated in the air supply source is changed depending on a sheet type of the sheet to be used for the image formation.

* * * * *